US009693637B1

(12) United States Patent
Kanzler

(10) Patent No.: US 9,693,637 B1
(45) Date of Patent: Jul. 4, 2017

(54) CHILD MOBILITY ASSISTING DEVICE

(71) Applicant: Estacia R. Kanzler, Round Lake, IL (US)

(72) Inventor: Estacia R. Kanzler, Round Lake, IL (US)

( * ) Notice: Subject to any disclaimer, the term of this patent is extended or adjusted under 35 U.S.C. 154(b) by 0 days.

(21) Appl. No.: 15/442,819

(22) Filed: Feb. 27, 2017

Related U.S. Application Data

(60) Provisional application No. 62/396,168, filed on Sep. 18, 2016.

(51) Int. Cl.
*A47D 13/04* (2006.01)

(52) U.S. Cl.
CPC ..... *A47D 13/04* (2013.01)

(58) Field of Classification Search
CPC ..... A47D 13/08
See application file for complete search history.

(56) References Cited

U.S. PATENT DOCUMENTS 2,869,686 A * 1/1959 Glanz ..... B62K 9/00 188/109
5,046,750 A * 9/1991 Heubl ..... B62K 9/00 280/47.34
6,457,731 B1 * 10/2002 Paranto ..... A63B 22/0002 280/208
7,182,351 B2 * 2/2007 Williams ..... A47D 13/04 280/32
8,496,261 B2 * 7/2013 Adams ..... A61G 5/00 280/250.1
2005/0248110 A1 * 11/2005 Stouffer ..... A61G 5/00 280/87.021
2013/0144475 A1 * 6/2013 Pidcoe ..... A47D 13/04 701/22
2014/0291952 A1 * 10/2014 Lehman ..... A47D 13/04 280/79.6

* cited by examiner

*Primary Examiner* — Kevin Hurley
(74) *Attorney, Agent, or Firm* — PatentFile, LLC; Bradley C. Fach; Steven R. Kick

(57) ABSTRACT

In some embodiments, a child mobility assisting device may include a body having a body support surface which may be formed by an upper torso supporting arm, a lower torso supporting arm, a central depression, a right wing, and a left wing. One or more transportation conveyances may be coupled to the body opposite the body support surface. Each transportation conveyance may support the body above a ground surface on a terminal surface while reducing the friction between the body and the ground surface. An arresting brake may also be coupled to the body opposite the body support surface. All or portions of the arresting brake may be positioned between the terminal surface of a wheel and the body support surface of the body so that if a transportation conveyance dips below another transportation conveyance, the arresting brake may then contact the ground surface and arrest the movement of the device.

15 Claims, 8 Drawing Sheets

CHILD MOBILITY ASSISTING DEVICE

CROSS REFERENCE TO RELATED APPLICATIONS

This application claims priority to and the benefit of the filing date of U.S. Provisional Application No. 62/396,168, filed on Sep. 18, 2016, entitled "CHILD MOBILITY ASSISTING DEVICE", which is hereby incorporated by reference in its entirety.

FIELD OF THE INVENTION

This patent specification relates to the field of child and infant mobility assisting devices. More specifically, this patent specification relates to a device configured to assist infants and children in the performance of learning to crawl.

BACKGROUND

Crawling is a typical part of early childhood development that starts between age 6 to 11 months. During this crucial time, infants use crawling to interact independently with their environment. This stage is important for developing strength, coordination, motor skills and cognitive development.

In 1994 the Academy of American Pediatrics started the "Back to Sleep" campaign to help prevent SIDS (Sudden Infant Death Syndrome). Studies have shown, as an inadvertent result of the campaign, that children are meeting their motor milestones later in addition to an increase in torticollis and plagiocephaly. This is due to the lack of time spent on their bellies, now known as "tummy time". Many children are born with conditions which hinder strength and/or motor development. Cerebral Palsy and spina bifida are examples of such conditions that could benefit from the independent mobility and environmental exploration provided by an infant crawling device.

Therefore a need exists for a novel device configured to assist infants and children in the performance of learning to crawl. There is also a need for novel mobility assisting device which is able provide children born with and without conditions which hinder strength and/or motor development with the benefit of the independent mobility and environmental exploration.

BRIEF SUMMARY OF THE INVENTION

A child mobility assisting device is provided. The device may be used to support portions of the ventral or anterior side of an individual thereby allowing the device to assist infants and children in the performance of learning to crawl and to provide independent mobility and environmental exploration.

In some embodiments, a child mobility assisting device may include a body having an upper torso supporting arm, a lower torso supporting arm, and a central depression. The body may further include a body support surface which may be formed by the upper torso supporting arm, lower torso supporting arm, central depression, a right wing, and a left wing. The body support surface fits the curvature of a child's body, allowing the child to rest comfortably on their stomach. In this position, the child is able to practice crawling and bilateral coordination by using the arms and legs in reciprocal movements. One or more transportation conveyances may be coupled to the body opposite the body support surface. Each transportation conveyance may support the body above a ground surface on a terminal surface while reducing the friction between the body and the ground surface. An arresting surface may also be coupled to the body opposite the body support surface. The arresting surface may be positioned between the terminal surface of a wheel and the body support surface of the body so that if a transportation conveyance dips below another transportation conveyance, the arresting surface may then contact the ground surface and arrest the movement of the device.

In further embodiments, a child mobility assisting device may comprise one or more skirts. A skirt may be coupled to one or more portions of the body, such as to the upper torso supporting arm, lower torso supporting arm, right wing, and/or left wing.

In still further embodiments, a skirt may form a shroud or protective covering to prevent access to the transportation conveyances while the transportation conveyances are supporting the device upon a ground surface.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
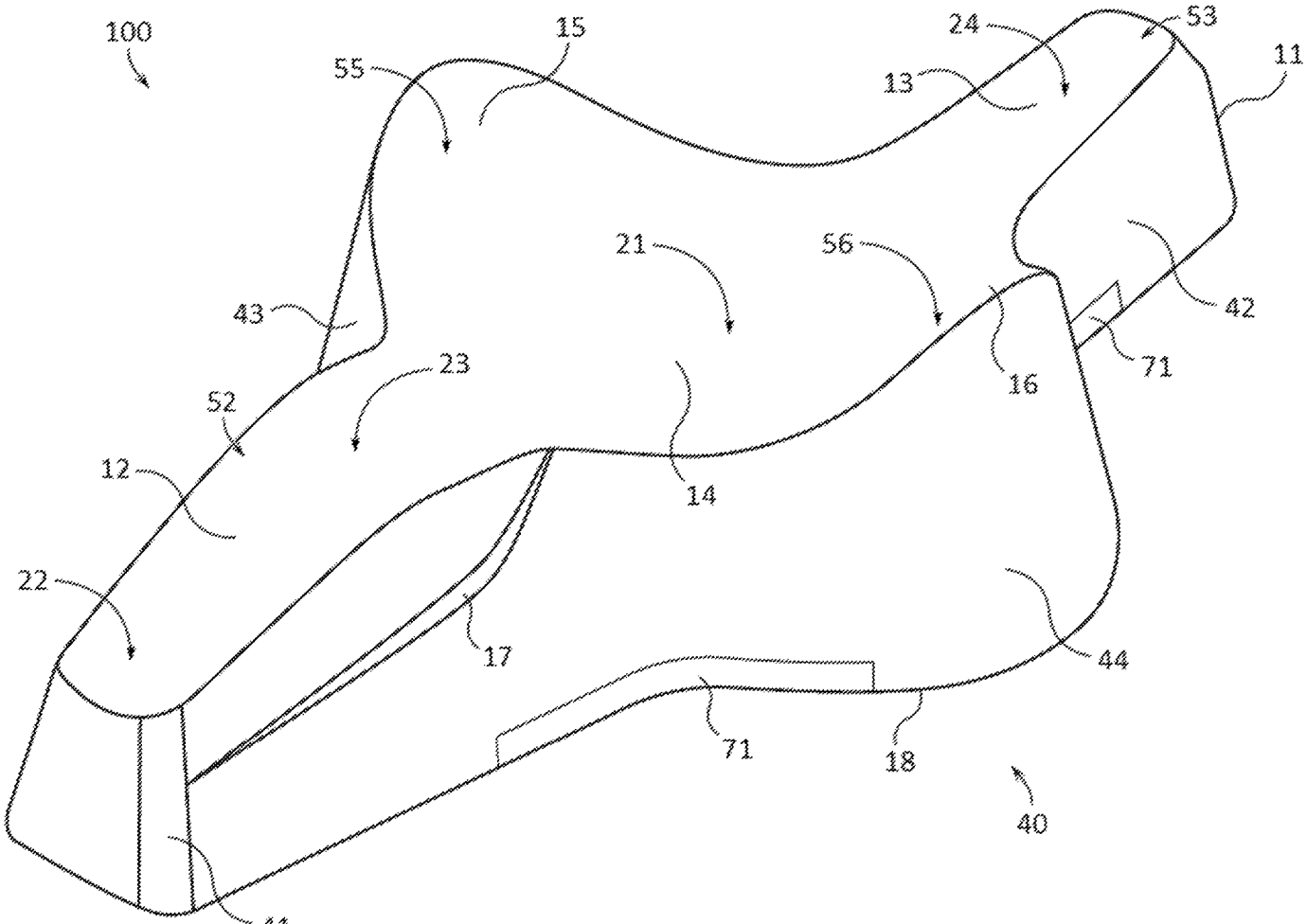
FIG. 1 depicts a top front perspective view of an example of a child mobility assisting device according to various embodiments described herein.
Figure 2:
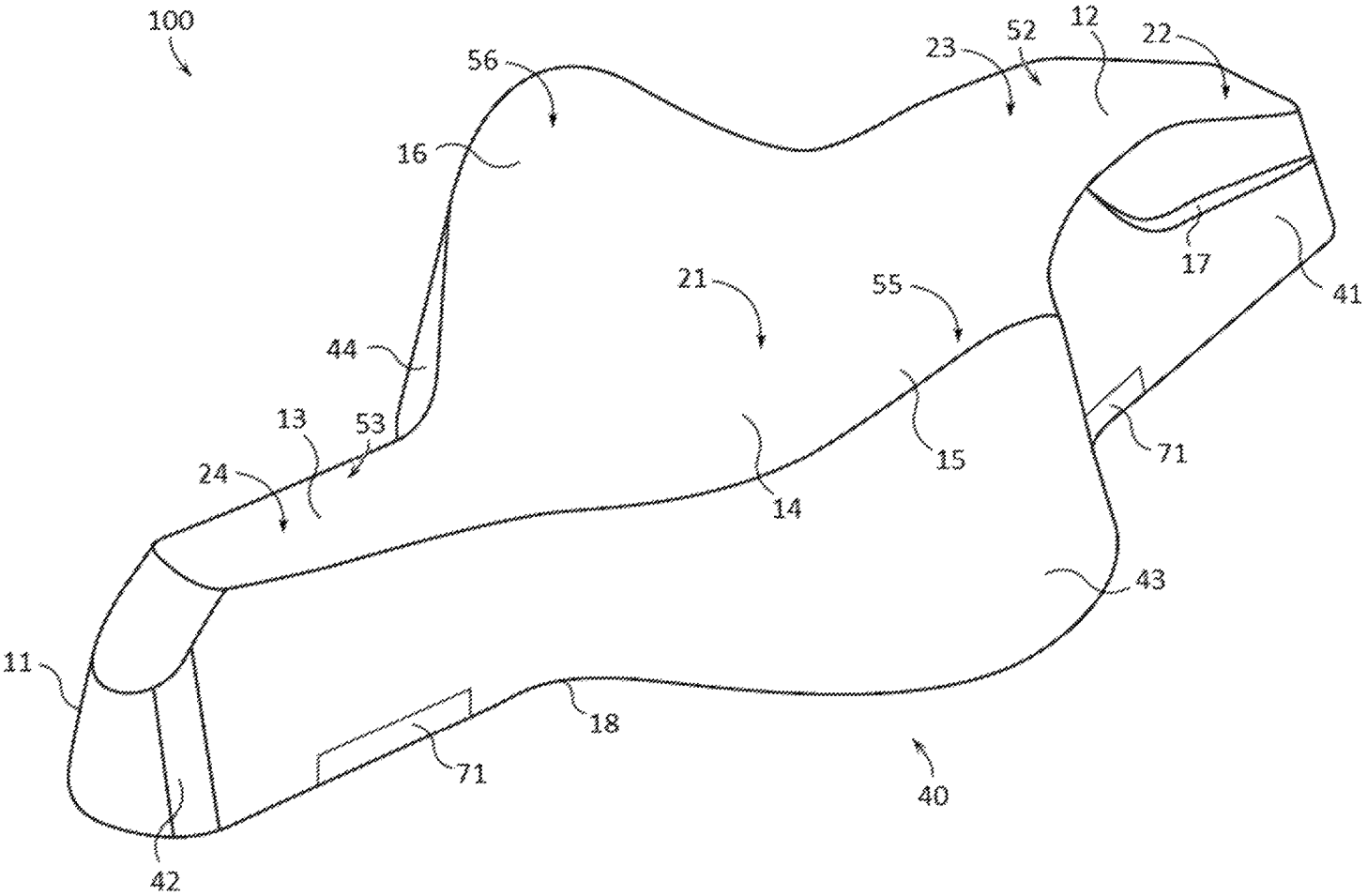
FIG. 2 illustrates a top rear perspective view of an example of a child mobility assisting device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new child and infant mobility assisting device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-7 illustrate examples of a child mobility assisting device ("the device") 100 according to various embodiments. In some embodiments, the device 100 may comprise a body 11 having a body support surface 21 which may be formed by one or more portions of an upper torso supporting arm 12, a lower torso supporting arm 13, a central depression 14, a right wing 15, and/or a left wing 16. One or more transportation conveyances 31 may be coupled to the body 11 opposite the body support surface 21. The transportation conveyances 31 may support the body 11 above a ground surface 200 while reducing the friction between the body 11 and the ground surface 200. One or more arresting brakes 71 (FIGS. 3-5, 7, and 8) may also be coupled to the body 11 opposite the body support surface 21. All or portions of an arresting brake 71, such as an arresting surface 72, may be slightly raised above the level plane formed at the interface 33 between the transportation conveyances 31 and the ground surface 200 so that if a transportation conveyance 31 dips below the level plane, the arresting brake 71 may then contact the ground surface 200 (FIG. 5) thereby arresting the movement of the device 100. Optionally, a transportation conveyance 31 may be configured to only enable one or two directional movement of the device 100 so that the device may only be moved in a generally single direction.

The body 11 may be shaped and contoured to support ventral or anterior portions of the body of a human. Preferably, the body 11 may comprise a central depression 14 which may enable the body 11 to be contoured to receive portions of the belly and lower chest of an individual. In some embodiments, the central depression 14 may be generally concave shaped and contoured to support ventral or anterior portions of the body, such as the abdomen and chest, of a child between six months and two years of age. In other embodiments, the central depression 14 may be shaped and contoured to support ventral or anterior portions of the body of a child, such as a developmentally challenged child between two years of age and six years of age. In alternative embodiments, the central depression 14 may be shaped and contoured to support ventral or anterior portions of the body of an individual, such as a developmentally challenged individual between six years of age and twenty years of age. It should be understood, that the body 11 and central depression 14 may be configured in a plurality of sizes to accommodate the ventral or anterior portions of individuals of any age, size, and body type.

The body 11 may comprise one or more body support surfaces 21 which may compose the portions of the device 100 upon which the body of a user may rest or be supported. In some embodiments, the device 100 may comprise a single large body support surface 21 which may extend across all or portions of an upper torso supporting arm 12, a lower torso supporting arm 13, a central depression 14, a right wing 15, and/or a left wing 16. In other embodiments, the device 100 may comprise two or more body support surfaces 21 which may be disposed on all or portions of an upper torso supporting arm 12, a lower torso supporting arm 13, a central depression 14, a right wing 15, and/or a left wing 16.

In some embodiments, the body 11 may comprise an upper torso supporting arm 12. The upper torso supporting arm 12 may comprise one or more upper supporting arm surfaces 52 which may form a portion of the body support surface 21. The upper torso supporting arm 12 may preferably be coupled to the central depression 14 and shaped to extend above the central depression 14 so that the upper chest and optionally the head and/or neck of an individual may be supported by the upper torso supporting arm 12 when the belly and lower chest of an individual is received in the central depression 14. In further embodiments, the upper torso supporting arm 12 may comprise a depressed upper distal surface 22 which may be lower than portions of the upper torso supporting arm 12 which are closer to the central depression 14. In still further embodiments, the upper torso supporting arm 12 may comprise a plateau surface 23 which may form the portions of the upper torso supporting arm 12 which extend highest above the central depression 14.

In some embodiments, the body 11 may comprise a lower torso supporting arm 13. The lower torso supporting arm 13 may comprise one or more lower supporting arm surfaces 53 which may form a portion of the body support surface 21. The lower torso supporting arm 13 may preferably be coupled to the central depression 14 opposite the upper torso supporting arm 12 and shaped to extend away and optionally above the central depression 14 so that the lower torso including the pelvis area of an individual may be supported by the lower torso supporting arm 13 when the belly and lower chest of an individual is received in the central depression 14. In further embodiments, the lower torso supporting arm 13 may comprise a lower distal surface 23 which may be raised above portions of the lower torso supporting arm 13 which are closer to the central depression 14. In still further embodiments, the lower torso supporting arm 13 may comprise one or more lower supporting arm surfaces 53 having one or more depressions or recesses which may be shaped to prevent excess pressure from being exerted on portions of the lower torso of an individual, such as to the pubic region. Generally, the lower torso supporting arm 13 may be shaped with a relatively narrow width that does not inhibit the motion of the legs during a crawling motion.

In some embodiments, the body 11 may comprise a right wing 15. The right wing 15 may comprise one or more right wing surfaces 55 which may form a portion of the body support surface 21. The right wing 15 may preferably be coupled to the central depression 14 between the upper torso supporting arm 12 and the lower torso supporting arm 13 and be shaped to extend away and optionally above the central depression 14 so that portions of the right side of the torso area of an individual may be supported by the right wing 15 when the belly and lower chest of an individual is received in the central depression 14. Generally, a right wing surface 55 of a right wing 15 may be shaped with a curved or rounded shape that does not inhibit the motion of the right arm and right leg during a crawling motion while supporting and/or preventing the right side of the torso area from falling off the body support surface 21.

In some embodiments, the body 11 may comprise a left wing 16. The left wing 16 may comprise one or more left wing surfaces 56 which may form a portion of the body support surface 21. The left wing 16 may preferably be coupled to the central depression 14 opposite the right wing 15 between the upper torso supporting arm 12 and the lower torso supporting arm 13 and be shaped to extend away and optionally above the central depression 14 so that portions of the left side of the torso area of an individual may be supported by the left wing 16 when the belly and lower chest of an individual is received in the central depression 14. Generally, a left wing surface 56 of the left wing 16 may be shaped with a curved or rounded shape that does not inhibit the motion of the left arm and left leg during a crawling motion while supporting and/or preventing the left side of the torso area from falling off the body support surface 21.

In preferred embodiments, the device 100 may comprise one or more upper supporting arm surfaces 52, lower supporting arm surfaces 53, right wing surfaces 55, and/or left wing surfaces 55 which may be continues with each other to form a single body support surface 21 which extends across the upper torso supporting arm 12, lower torso supporting arm 13, central depression 14, right wing 15, and left wing 16. In other embodiments, the device 100 may comprise one or more upper supporting arm surfaces 52, lower supporting arm surfaces 53, right wing surfaces 55, and/or left wing surfaces 55 which may be continuous with one or more other surfaces 22, 23, 24, 52, 53, 55, 56, to form two or more body support surfaces 21 which may extend across all or portions of the upper torso supporting arm 12, lower torso supporting arm 13, central depression 14, right wing 15, and/or left wing 16.

As perhaps best shown in FIGS. 3-5, and 7, the device 100 may comprise one or more transportation conveyances 31 which may be coupled to the body 11 opposite the body support surface 21. The transportation conveyances 31 may support the body 11 above a ground surface 200 while reducing the friction between the body 11 and the ground surface 200. Each transportation conveyance 31 may comprise a terminal surface 34 which may be the portion of the transportation conveyance 31 that is farthest from the body support surface 21 and therefore is the portion of the transportation conveyance 31 that may contact a ground surface 300 that the device 100 is placed upon. In this manner, a terminal surface 34 and ground surface 200 may form an interface 33 when the terminal surface 34 and ground surface 200 are in contact with each other. When the device 100 is placed on a flat or level ground surface 200, the interface 33 between each transportation conveyance 31 and the ground surface 200 may be in a flat or level plane.

The one or more transportation conveyances 31 may be coupled with any suitable coupling method to the body 11 to form a level plane at the interface 33 between the transportation conveyances 31 and a ground surface 200 upon which the device 100 is supported. A transportation conveyance 31 may comprise a wheel, a caster, a tread or track, a low friction pad or bumper, a low friction plate, a ski, a pontoon, or any other suitable device configured to reduce the friction between the device 100 and the surface over which it is desired to be moved. In preferred embodiments, a transportation conveyance 31 may comprise a swivel caster which allows for movement in multiple directions. They can have one or two sets of raceways that allow the caster to swivel 360 degrees under a load. Swivel casters may include locking casters, kingpin-less casters, hollow kingpin casters, plate casters, stem casters, or any other suitable caster which allows for movement in multiple directions.

In some embodiments, the device 100 may comprise one or more transportation conveyances 31 configured as a uni-directional transportation conveyance 31A which may be coupled to the body 11 opposite the body support surface 21 and which may only allow movement in a first and second direction. For example, a uni-directional transportation conveyance 31A may only allow the device 100 to move forwards and backwards across a ground surface 200 upon which the device 100 is supported. In preferred embodiments, a uni-directional transportation conveyance 31A may comprise a rigid caster which only allows forward and backward movement. In other embodiments, a uni-directional transportation conveyance 31A may comprise a wheel with a fixed axle although any other type of transportation conveyance which may be configured to only allow forward and backward movement may be used.

In some embodiments, the body 11 may comprise one or more skirts, such as a anterior skirt 41, posterior skirt 42, right skirt 43, and left skirt 44, which may be coupled to the portions of the body 11 and extend away from the body support surface 21. A skirt 41, 42, 43, 44, may form a shroud or protective covering to prevent access to the transportation conveyances 31 while the transportation conveyances 31 are supporting the device 100 upon a ground surface 200. Preferably, when the device 100 is positioned on a level ground surface 200 and supported by the transportation conveyances, the one or more skirts 41, 42, 43, 44, may be separated from the ground surface 200 by a distance of between one inch and 0.05 inches and more preferably by a distance of between 0.05 inches and 0.5 inches. In this manner the one or more skirts 41, 42, 43, 44, may prevent the fingers, hands, arms, legs, feet, and/or toes from being inserted between the skirts 41, 42, 43, 44, and the ground surface 200 and pinched or otherwise injured between the transportation conveyances 31 and the ground surface 200.

In some embodiments, an anterior skirt 41 may be coupled to all or portions of an upper supporting arm 12, a posterior skirt 42 may be coupled to all or portions of lower torso supporting arm 13, a right skirt 43 may be coupled to all or portions of a right wing 15, and a left skirt 44 may be coupled to all or portions of a left wing 16. In the examples of FIGS. 1-7, the skirts 41, 42, 43, 44, may be continuous to form a single skirt structure 40 that extends from the body support surface 21 towards the transportation conveyances so that all the transportation conveyances are disposed within the single skirt structure 40.

In alternative embodiments, the device 100 may comprise one or more skirt structures 40 formed by one or more skirts 41, 42, 43, 44. For example, the device 100 may comprise four transportation conveyances 31, with the first transportation conveyance 31 surrounded or shrouded by an anterior skirt 41, the second transportation conveyance 31 surrounded or shrouded by a posterior skirt 42, the third transportation conveyance 31 surrounded or shrouded by a right skirt 43, and the fourth transportation conveyance 31 surrounded or shrouded by a left skirt 44, thereby resulting in a device having four skirt structures 40. In a further example, the device 100 may comprise four transportation conveyances 31, with the first transportation conveyance 31 surrounded or shrouded by an anterior skirt 41, the second transportation conveyance 31 surrounded or shrouded by a posterior skirt 42, and both the third and fourth transportation conveyances 31 surrounded or shrouded by a right skirt 43 that is continuous with a left skirt 44, thereby resulting in a device 100 having three skirt structures 40.

In some embodiments, the body 11, including an upper torso supporting arm 12, a lower torso supporting arm 13, a central depression 14, a right wing 15, and/or a left wing 16, may be configured in a generally cross shape or "t" shape. However, it should be understood to one of ordinary skill in the art that the body 11, including an upper torso supporting arm 12, a lower torso supporting arm 13, a central depression 14, a right wing 15, a left wing 16, a skirt structure 40, an anterior skirt 41, a posterior skirt 42, a right skirt 43, and/or a left skirt 44 may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

One or more arresting brakes 71 may be coupled to the body 11 opposite the body support surface 21. In some embodiments, all or portions of an arresting brake 71 may be positioned between the terminal surface 34 of a transportation conveyance 31 and the body support surface 21 of the body 11. An arresting brake 71 may comprise an arresting surface 72 which may form the portion of the arresting brake 71 that may contact a ground surface 200. An arresting surface 72 of an arresting brake 71 may be slightly raised above the level plane formed at the interfaces 33 between the transportation conveyances 31 and the ground surface 200 that is supporting the device 100 so that if a transportation conveyance 31 dips below the level plane, the arresting surface 72 of an arresting brake 71 may then contact the ground surface 200 thereby frictionally arresting the movement of the device 100. For example, if the device 100 is being supported by a ground surface 200 that is proximate to a set of descending stairs and the device 100 is moved so that a transportation conveyance 31 falls off the ground surface 200 over the stairs, thereby dipping below the level plane, the arresting surface 72 of an arresting brake 71 may then contact the ground surface 200 to frictionally arrest the movement of the device 100 so that the device 100 is unable to continue moving. In this manner, the arresting brake 71 may prevent the device 100 and an individual disposed thereon from tumbling or falling down the set of descending stairs.

Figure 3:
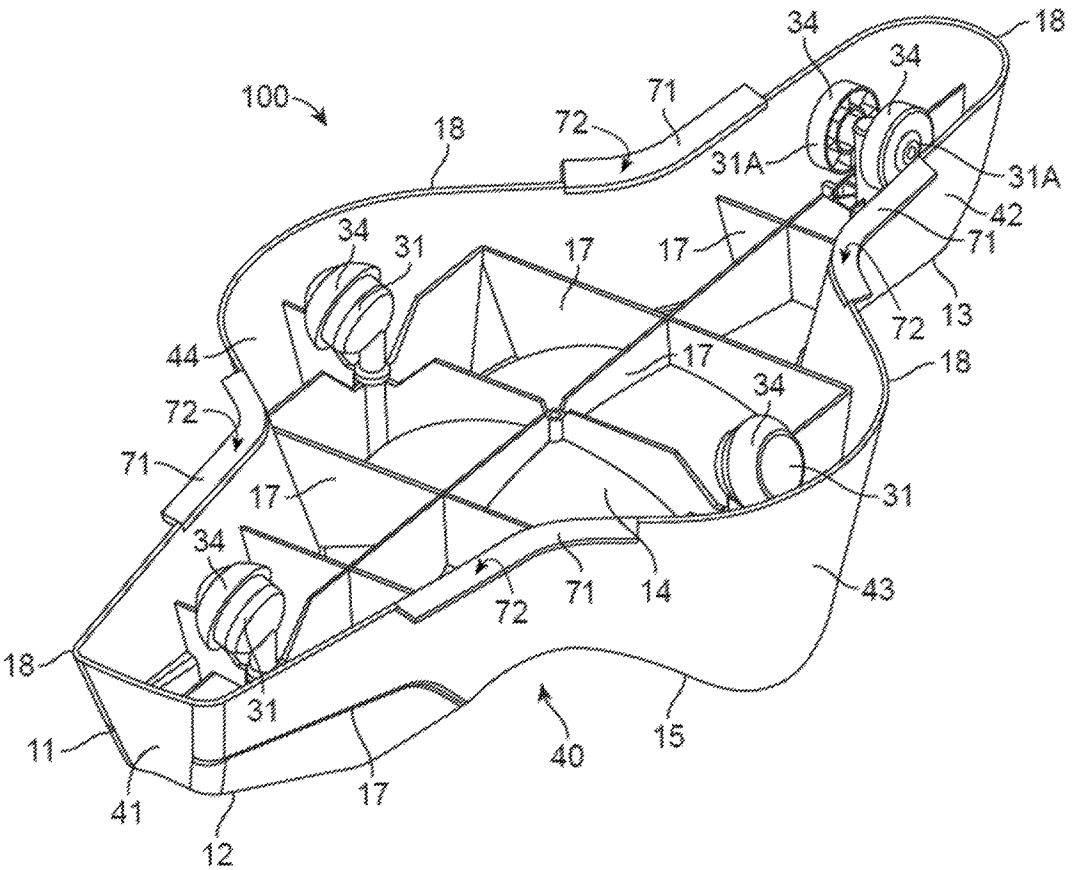
FIG. 3 shows a bottom front perspective view of another example of a child mobility assisting device according to various embodiments described herein.
Figure 4:
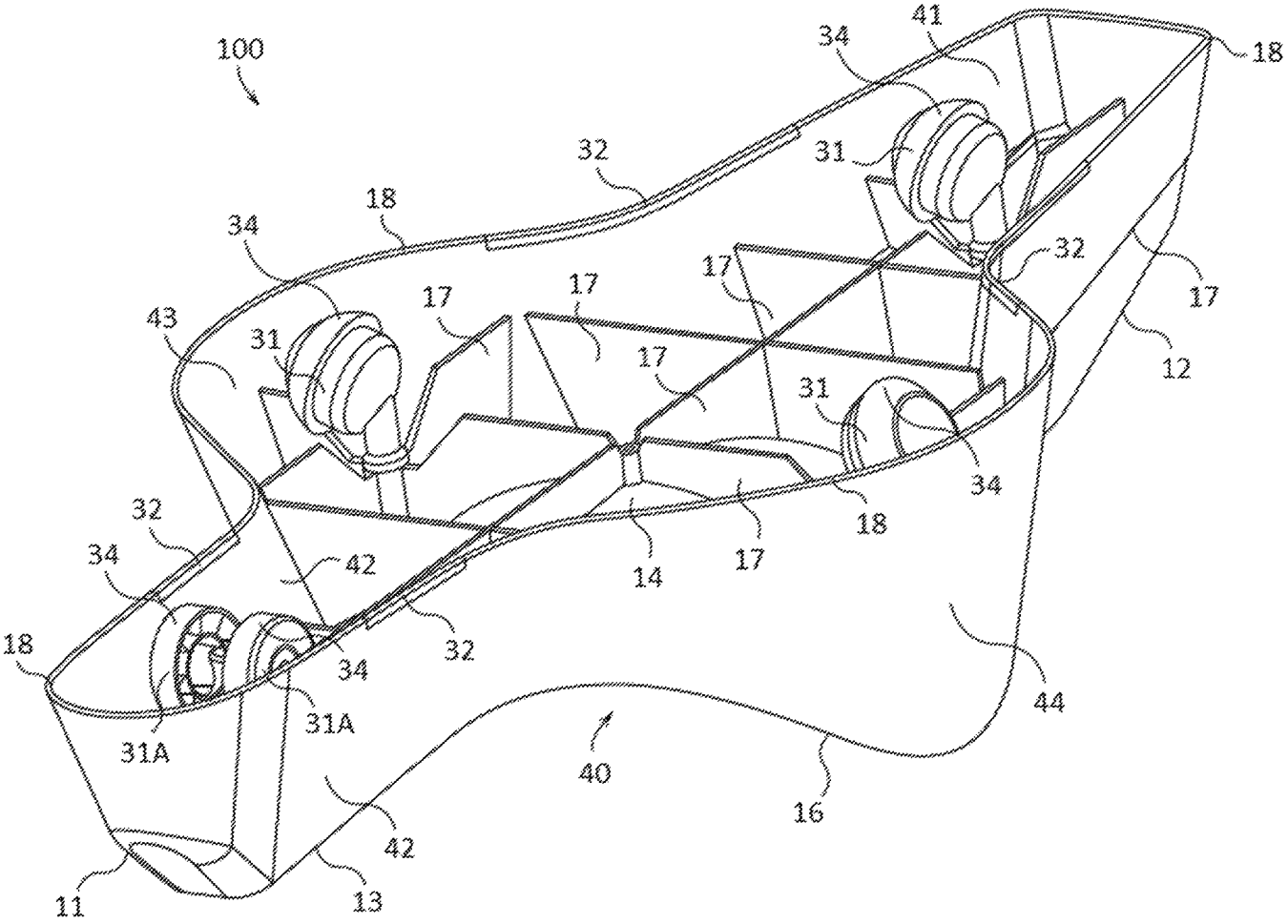
FIG. 4 depicts a bottom rear view of an example of a further child mobility assisting device according to various embodiments described herein.
Figure 5:
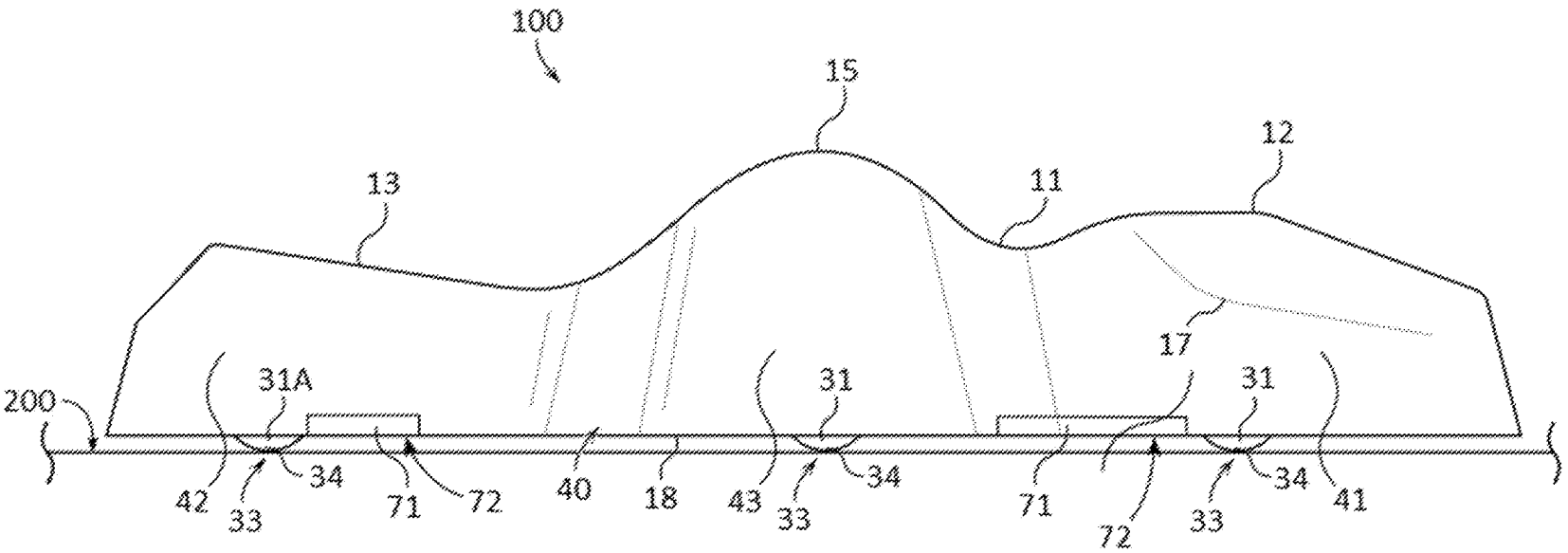
FIG. 5 illustrates a side elevation view of an example of a child mobility assisting device on a ground surface according to various embodiments described herein.
Figure 6:
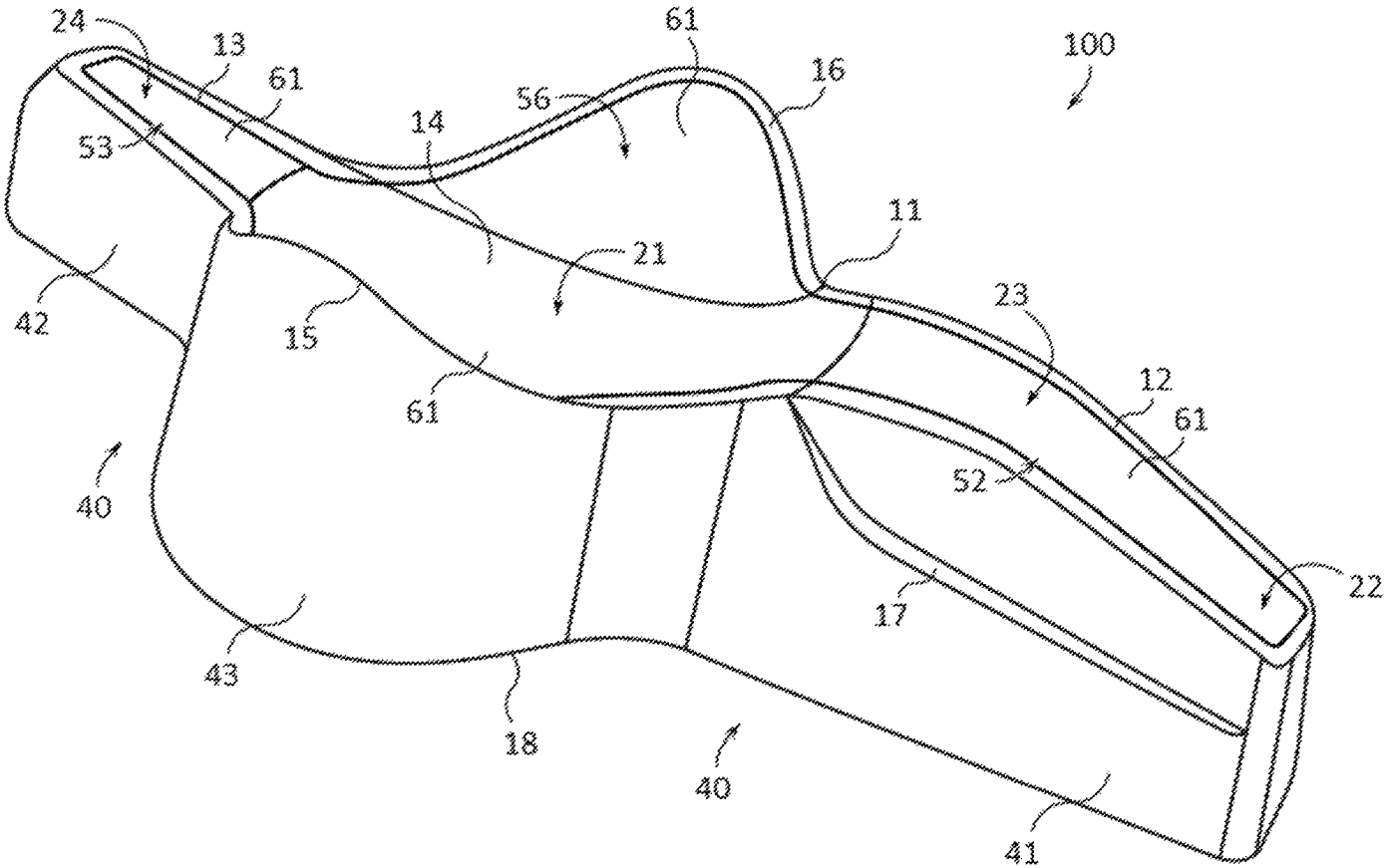
FIG. 6 shows a top perspective view of still another example of a child mobility assisting device according to various embodiments described herein.
Figure 8:
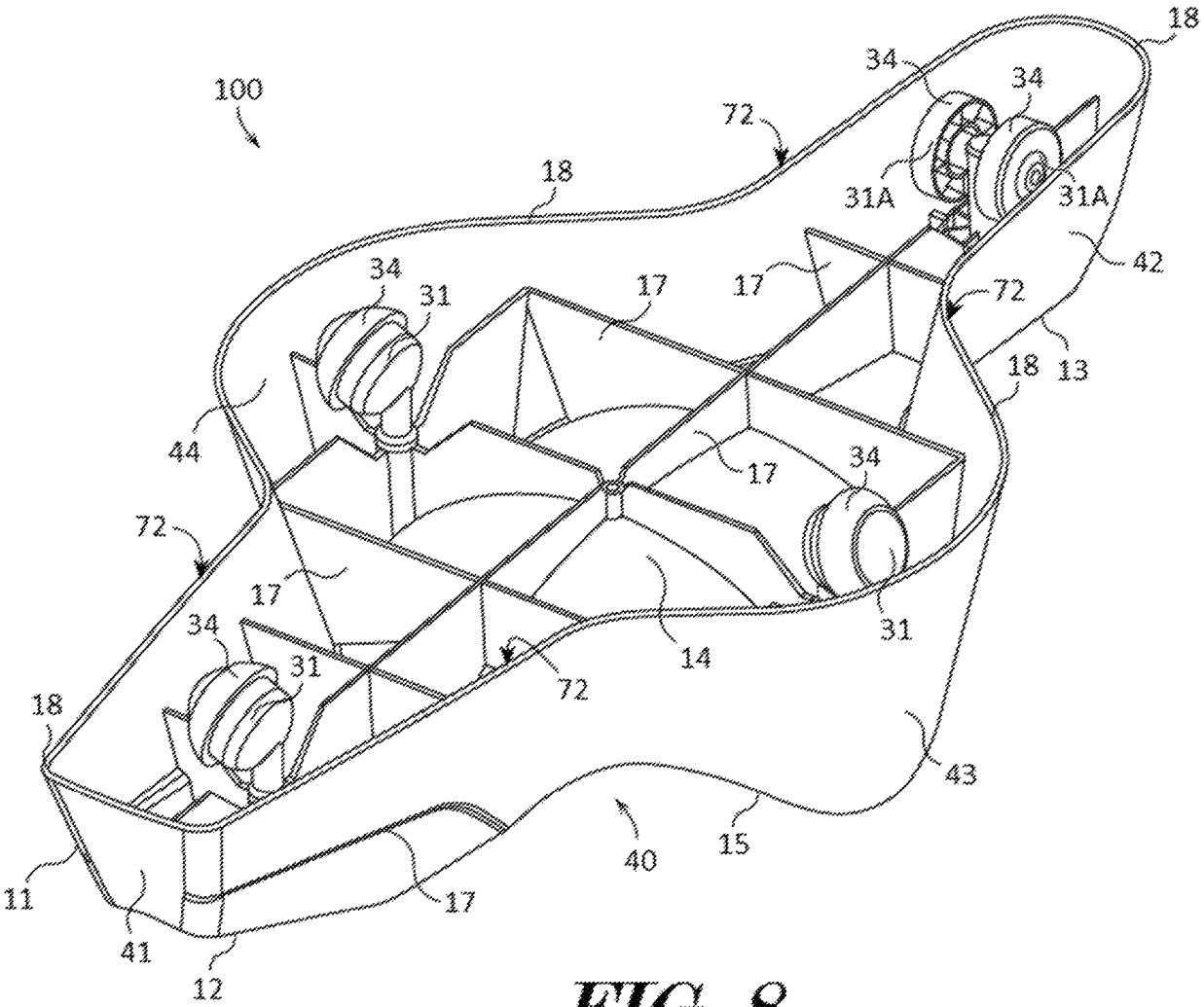
FIG. 8 illustrates a bottom view of an additional example of a child mobility assisting device according to various embodiments described herein.

In some embodiments, an arresting surface 72 may be generally flat planar in shape. In other embodiments, an arresting surface 72 may comprise texturing, such as ridges, bumps, or the like which may increase the frictional resistance between the arresting surface and a ground surface 200. In still further embodiments, an arresting surface 72 may comprise a convex shape that may curve away from the body support surface 21 of the body 11. Additionally, an arresting surface may be any shape or size. In some embodiments, an arresting surface 72 of an arresting brake 71 may have a greater width than the width of the lower perimeter 18 as shown in FIG. 3. In other embodiments, an arresting surface 72 of an arresting brake 71 may have a width approximately the same as the width of the lower perimeter 18 as shown in FIG. 4. In still other embodiments, an arresting surface 72 formed by all or portions of the lower perimeter 18 may have the same width as one or more other portions of the lower perimeter 18 as shown in FIG. 8.

In some embodiments, the device 100 may comprise a skirt structure 40 or skirt 41, 42, 43, 44, having a lower perimeter 18 in which all or portions of the lower perimeter 18 may be configured to function as an arresting brake 71. A lower perimeter 18 may have an arresting surface 72 which may be slightly raised above the level plane formed at the interfaces 33 between the transportation conveyances 31 and the ground surface 200 that is supporting the device 100 so that if a transportation conveyance 31 dips below the level plane, the arresting surface 72 of the lower perimeter 18 may then contact the ground surface 200 thereby arresting the movement of the device 100. A lower perimeter 18 may be configured in a plurality of sizes and shapes such as the generally flat planar shape, a rounded or curved shape, a square shape, triangular prism shape, or any other shape including combinations of shapes. In further embodiments, the device 100 may comprise two or more lower perimeters 18 such as two or more lower perimeters 18 shaped as bumpers, stops, or the like which may be spaced at intervals along the lowest portions of a skirt structure 40 or skirt 41, 42, 43, 44.

In preferred embodiments, the device 100 may comprise one or more arresting brakes 71 which may be coupled to portions of one or more skirt structures 40 or skirts 41, 42, 43, 44, such as to a lower perimeter 18. For example and as shown in FIGS. 1-5 and 8, the device 100 may comprise a first arresting brake 71 coupled to portions of the anterior skirt 41 and left skirt 44 of the skirt structure 40, a second arresting brake 71 coupled to portions of the anterior skirt 41 and right skirt 43 of the skirt structure 40, a third arresting brake 71 coupled to portions of the right side of the posterior skirt 42 of the skirt structure 40, and a fourth arresting brake 71 coupled to portions of the left side of the posterior skirt 42 of the skirt structure 40. In further embodiments, the device 100 may comprise one, two, three, five, six, seven, eight, nine, ten, or more arresting brakes 71 which may be coupled to portions of one or more skirt structures 40 or skirts 41, 42, 43, 44, such as to a lower perimeter 18. In alternative embodiments, the device 100 may comprise a single arresting brake 71 which may be continuous along the entire lower perimeter 18 of one or more skirt structures 40 or skirts 41, 42, 43, 44.

An arresting brake 71 may be configured in a plurality of sizes and shapes such as a generally flat planar shape, a rounded or curved shape, a square shape, triangular prism shape, or any other shape including combinations of shapes. For example and as shown in FIGS. 1-5, and 8 an arresting brake 71 may comprise an elongated flat planar shape and may be coupled to a skirt structure 40, anterior skirt 41, posterior skirt 42, right skirt 43, and/or left skirt 44 such as by being coupled or formed with a lower perimeter 18. In another example and as shown in FIG. 7, an arresting brake 71 may comprise a flat planar shape formed by one or more elongated branches 73 and/or lateral branches 74 which may be coupled to any element of the device 100 such as to the a support rib 17, skirt structure 40, anterior skirt 41, posterior skirt 42, right skirt 43, and/or left skirt 44.

In some embodiments, an arresting brake 71 and/or an arresting surface 72 may be made from or comprise a material having a friction coefficient value preferably and approximately greater than one when placed in contact with common flooring surfaces such as carpeting, tile, linoleum, wood, laminate, and the like. For example, an arresting brake 71 may be made from or comprise a flexible or resilient material such as silicone foams, ethylene propylene diene monomer (EPDM) rubber, a thermoplastic elastomer (TPE) mix of plastic and rubber, a thermoplastic olefin (TPO) polymer/filler blend, silicone rubber, rubber foams, urethane foams, plastic foams, neoprene foam, latex foam rubber, polyurethane foam rubber, or elastomer materials such as elastic plastics, Ethylene-vinyl acetate (EVA), ethylene propylene rubber (EPM), ethylene propylene diene rubber (EPDM), Epichlorohydrin rubber (ECO), Polyacrylic rubber (ACM, ABR), Silicone rubber (SI, Q, VMQ), elastic silicone, elastic rubbers, or any other suitable material including combinations of materials.

Figure 7:
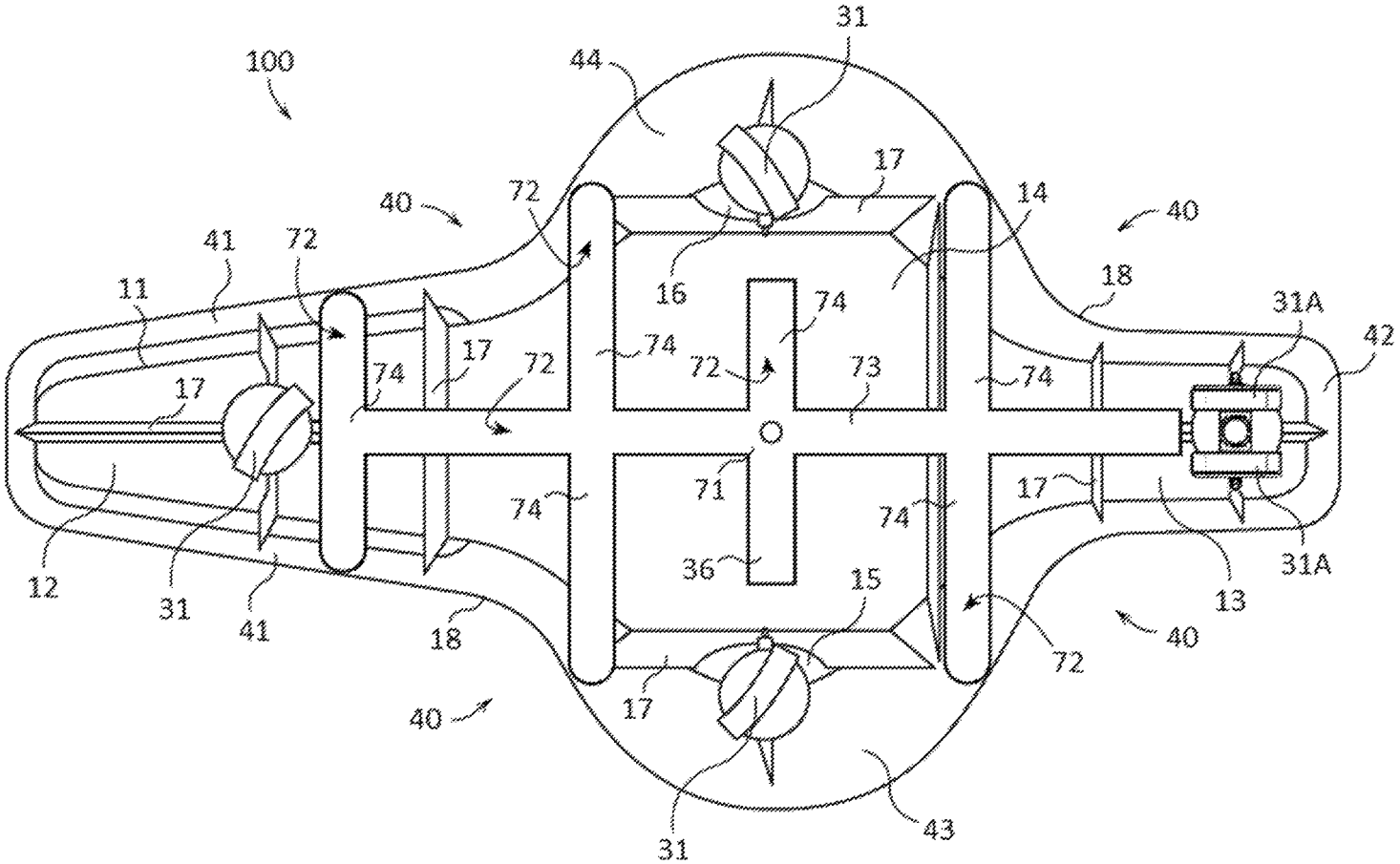
FIG. 7 depicts a bottom plan view of still a further example of a child mobility assisting device according to various embodiments described herein.

In some embodiments and as shown in FIG. 7, an arresting brake 71 may be coupled to the body 11 on the side of the body 11 opposite the body contacting surface 21, such as to one or more support ribs 17. A support rib 17 may couple, bridge, or provide structural support between one or more elements of the device 100. In further embodiments, a support rib 17 may form an arresting brake 71. In still further embodiments, a support rib 17 may extend across portions of the body 11 opposite the body support surface 21 with one or more transportation conveyances recessed into the support rib 17. Optionally, a support rib 17 may function as an arresting brake 71.

In some embodiments, all or portions of the body support surface 21, upper distal surface 22, plateau surface 23, and/or lower distal surface 24 may be formed by or comprise one or more cushioning elements 61 which may be configured to absorb impacts or provide a resilient comfortable surface between portions of a user's body which may contact the device 100 and the body 11. In some embodiments, a cushioning element 61 may comprise silicone rubber. In other embodiments, a cushioning element 61 may comprise a resilient and/or cushioning material such as silicone foams, rubber foams, urethane foams including ARTiLAGE foams and Poron foams, plastic foams, neoprene foam, latex foam rubber, polyurethane foam rubber, or elastomer materials such as elastic plastics, elastic silicone, elastic rubbers, cotton or other natural material or fabric padding, nylon or other synthetic material or fabric padding, or any other suitable elastomer or cushioning material including combinations of materials.

While some materials have been provided, in other embodiments, the elements that comprise the device 100 such as the body 11, body contacting surface 21, upper torso supporting arm 12, lower torso supporting arm 13, central depression 14, right wing 15, left wing 16, lower perimeter 18, arresting brake 71, optional skirt structure 40, optional anterior skirt 41, optional posterior skirt 42, optional right skirt 43, optional left skirt 44, optional cushioning element 61, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A child mobility assisting device for use on a ground surface, the device comprising:

a. a body having an upper torso supporting arm, a lower torso supporting arm, and a central depression;

b. a body support surface formed by the body;

c. two or more transportation conveyances coupled to the body opposite the body support surface, wherein each transportation conveyance has a terminal surface, and wherein the transportation conveyances support the body above the ground surface; and d. an arresting surface comprising an arresting brake coupled to a perimeter lip of a skirt, the arresting surface disposed on the body opposite to the body support surface, wherein the arresting surface is positioned between the terminal surface of a transportation conveyance and the body support surface of the body.

2. The device of claim 1, wherein the device comprises a multi-directional transportation conveyance comprising a swivel caster which allows for multi-direction movement.

3. The device of claim 1, wherein the device comprises a uni-directional transportation conveyance comprising a rigid caster which only allows forward and backward movement.

4. The device of claim 1, wherein the upper torso supporting arm, lower torso supporting arm, and central depression each form a portion of the body support surface.

5. The device of claim 1, further comprising a right wing and left wing.

6. The device of claim 5, wherein the right wing and left wing each form a portion of the body support surface.

7. The device of claim 1, wherein the skirt surrounds at least one transportation conveyance.

8. The device of claim 1, further comprising a right wing and left wing, and wherein the skirt is coupled to the upper torso supporting arm, the lower torso supporting arm, the right wing, and the left wing.

9. A child mobility assisting device for use on a ground surface, the device comprising:

a. a body having an upper torso supporting arm, a lower torso supporting arm, a right wing, and a left wing;

b. a body support surface formed by the body;

c. two or more transportation conveyances coupled to the body opposite the body support surface, wherein each transportation conveyance has a terminal surface, and wherein the transportation conveyances support the body above the ground surface;

d. a skirt coupled to the upper torso supporting arm, the lower torso supporting arm, a right wing, and left wing; and e. an arresting surface comprising an arresting brake coupled to a perimeter lip of the skirt, the arresting surface disposed on the body opposite the body support surface, wherein the arresting surface is positioned between the terminal surface of a transportation conveyance and the body support surface of the body.

10. The device of claim 9, further comprising a central depression.

11. The device of claim 10, wherein the upper torso supporting arm, lower torso supporting arm, and central depression each form a portion of the body support surface.

12. The device of claim 9, wherein the device comprises a multi-directional transportation conveyance comprising a swivel caster which allows for multi-direction movement.

13. The device of claim 9, wherein the device comprises a uni-directional transportation conveyance comprising a rigid caster which only allows forward and backward movement.

14. The device of claim 9, wherein the right wing and left wing each form a portion of the body support surface.

15. The device of claim 9, wherein the skirt surrounds at least one transportation conveyance.

* * * * *